US010079119B2

(12) United States Patent
Han et al.

(10) Patent No.: US 10,079,119 B2
(45) Date of Patent: Sep. 18, 2018

(54) ARC ABLATION-RESISTANT TUNGSTEN ALLOY SWITCH CONTACT AND PREPARATION METHOD THEREOF

(71) Applicant: NANTONG MEMTECH TECHNOLOGIES CO., LTD., Nantong, Jiangsu (CN)

(72) Inventors: Huisheng Han, Jiangsu (CN); Zhenxing Wang, Jiangsu (CN); Yang Ding, Jiangsu (CN); Hongmei Zhang, Jiangsu (CN)

(73) Assignee: NANTONG MEMTECH TECHNOLOGIES CO., LTD., Nantong, Jiangsu (CN)

( * ) Notice: Subject to any disclaimer, the term of this patent is extended or adjusted under 35 U.S.C. 154(b) by 0 days.

(21) Appl. No.: 15/318,144

(22) PCT Filed: Jul. 15, 2015

(86) PCT No.: PCT/CN2015/084164
§ 371 (c)(1),
(2) Date: Dec. 12, 2016

(87) PCT Pub. No.: WO2016/011908
PCT Pub. Date: Jan. 28, 2016

(65) Prior Publication Data

US 2017/0125180 A1 May 4, 2017

(30) Foreign Application Priority Data

Jul. 21, 2014 (CN) ..... 2014 1 0349019

(51) Int. Cl.
*H01H 1/021* (2006.01)
*H01H 11/04* (2006.01)
(Continued)

(52) U.S. Cl.
CPC ..... *H01H 1/021* (2013.01); *C23C 18/1633* (2013.01); *C23C 18/1692* (2013.01);
(Continued)

(58) Field of Classification Search
CPC .... H01H 11/041; H01H 11/042; H01H 11/06; C23C 18/1633; C23C 18/48; C25D 3/12; H05K 1/02
(Continued)

(56) References Cited

U.S. PATENT DOCUMENTS 3,721,778 A * 3/1973 Seeger, Jr. ..... H01H 13/702 200/5 R
3,852,879 A 12/1974 Krock
(Continued)

FOREIGN PATENT DOCUMENTS

| | | |
|---|---|---|
| CN | 103547056 | 1/2014 |
| CN | 103700517 | 4/2014 |
| CN | 104103435 | 10/2014 |

OTHER PUBLICATIONS

International Search Report filed in PCT/CN2015/084164 dated Aug. 25, 2015.

*Primary Examiner* — Renee S Luebke
*Assistant Examiner* — William Bolton
(74) *Attorney, Agent, or Firm* — Rankin, Hill & Clark LLP

(57) ABSTRACT

An arc-ablation resistant tungsten alloy switch contact and preparation method is disclosed. A contact member has a three-layer structure, wherein a first layer is a hydrophobic rubber layer, a second layer is a sheet metal layer, and a third layer is a tungsten alloy chemical deposition layer. A plating bath adopted in the chemical deposition contains 25-125 g/L soluble tungsten compound, 0-60 g/L soluble compound of a transition metal like ferrum, nickel, cobalt, copper or
(Continued)

manganese, and 0-30 g/L soluble compound of tin, stibium, lead or bismuth. When a layered complex of the hydrophobic rubber layer and the sheet metal layer is chemically plated by the plating bath, a tungsten alloy plated layer is selectively deposited on a metal surface, and chemical deposition of the tungsten alloy does not occur on a surface of the hydrophobic rubber fundamentally.

16 Claims, 2 Drawing Sheets

(51) Int. Cl.

| | |
|---|---|
| ***H01H 11/06*** | (2006.01) |
| ***C23C 18/48*** | (2006.01) |
| ***C25D 3/12*** | (2006.01) |
| ***C25D 3/56*** | (2006.01) |
| ***C23C 18/16*** | (2006.01) |
| ***C23C 18/18*** | (2006.01) |
| ***C23C 18/32*** | (2006.01) |
| ***C23C 18/50*** | (2006.01) |
| ***C23C 18/52*** | (2006.01) |
| ***C25D 7/06*** | (2006.01) |
| ***C25D 7/00*** | (2006.01) |

(52) U.S. Cl.
CPC ..... *C23C 18/1806* (2013.01); *C23C 18/1844* (2013.01); *C23C 18/32* (2013.01); *C23C 18/48* (2013.01); *C23C 18/50* (2013.01); *C23C 18/52* (2013.01); *C25D 3/12* (2013.01); *C25D 3/562* (2013.01); *C25D 7/00* (2013.01); *H01H 11/041* (2013.01); *H01H 11/042* (2013.01); *H01H 11/06* (2013.01); *H01H 2011/046* (2013.01); *H01H 2011/067* (2013.01)

(58) Field of Classification Search
USPC ..... 218/146, 123, 130; 200/262
See application file for complete search history.

(56) References Cited

U.S. PATENT DOCUMENTS 3,862,381 A * 1/1975 Glaister ..... H01H 13/702 200/5 A
4,749,830 A * 6/1988 Kippenberg ..... H01H 1/0203 218/123
6,399,219 B1 * 6/2002 Welty ..... B05D 5/067 428/626
7,179,546 B1 * 2/2007 Chen ..... B05D 5/067 428/698

* cited by examiner

ARC ABLATION-RESISTANT TUNGSTEN ALLOY SWITCH CONTACT AND PREPARATION METHOD THEREOF

TECHNICAL FIELD

The present invention particularly relates to a spare part between two conductors in a switch or a circuit of an electric or electronic product allowing a current to pass through mutual contact (i.e., an electric contact or contact) and a preparation method thereof.

BACKGROUND

An electrical contact or contact is an important spare part between two conductors in a switch or a circuit allowing a current to pass through mutual contact, which bears the functions of connecting, carrying and disconnecting a normal current and a fault current. The quality and service life of the contact directly determines the quality and service life of the entire switch or circuit. The electrical contact or contact is mainly used in a relay, a contactor, an air switch, a current limiting switch, a motor protector, a microswitch, an instrument, a computer keyboard, a hand-held set, a household appliance, an automotive electrical appliance (a window switch, a rear-view mirror switch, a lamp switch, a starter motor and other load switch), a leakage protection switch, or the like. The electric contact or contact may be prepared of multiple materials, which mainly include silver, silver-nickel, silver-copper oxide, silver-cadmium oxide, silver-tin oxide, silver-tin oxide-indium oxide, silver-zinc oxide, red copper, brass, phosphor copper, bronze, tin-copper, beryllium copper, copper-nickel, zinc-cupro-nickel, stainless steel, or the like.

In automotive appliances, household appliances, computer keyboards, hand-held sets and other devices, switch components thereof are usually printed circuit boards (PCB) provided with contacts and provided with combinations of contacts and rubber keypads. A circular contact on the PCB is divided into two non-conducting halves by a straight line or curve (like an S-shaped curve, and an M-shaped curve). The contact on the keypad is a circle without splitting. A circuit on the PCB can be switched on by using a circular contact of the same diameter on the keypad to make a face-to-face contact with the circular contact on the PCB. The contact on the keypad is made of conductive rubber or metal. The conductive rubber has a larger contact resistance when being contacted with the contact of the PCB. The conductive rubber contact is not suitable for switching on a PCB circuit having a large current (such as current greater than 50 mA). The metal contact has a smaller contact resistance when being contacted with the contact of the PCB. The metal contact not only can be used to switch on a PCB circuit having a smaller current, but also can be used to switch on a PCB circuit having a larger current. However, the metal contact has the problems of unsatisfactory chemical corrosion resistance, unsatisfactory arc-erosion resistance and high production cost at present, thus limiting the applications thereof.

In the atmosphere, a switching element usually generates an electric spark or electric arc when switching on or switching off a circuit. The subsistence of the electric arc phenomenon of the switch will result in contact oxidation and ablation, and may carbonize organic matters in the air, thus producing carbon deposition, which gradually increases a contact resistance of the switch and even causes a circuit break of the switch.

A patent document with a patent application number of 201220499100.X discloses a "Three-layer Composite Electric Contact", wherein the contact is provided with a layer of silver plated on a contact surface of a copper-based contact body, so that the contact has better electrical conductivity, and the production cost is saved than that of completing using silver to produce the contact. Although the electrical conductivity and heat conductivity of the silver are highest among all the metals, the silver has poorer atmosphere corrosion resistance and poorer salt-mist resistance. The silver is easily reacted with sulphuretted hydrogen ($H_2S$) in the atmosphere to generate black silver sulfide. When the silver is used as a contact, although the primary surface resistance is smaller, the service life of the silver in the atmosphere is also limited. Although the cost of silver plating is lower than that of gold, the silver is still one of precious metals. Moreover, in such an electric contact, no rubber layer is provided; therefore, this electric contact is not suitable for performing heat vulcanization adhesion and heat vulcanization shaping with rubber to prepare a rubber keypad containing electric contact. Only a contact containing a rubber layer or a contact entirely made of conductive rubber can possibly perform heat vulcanization adhesion and heat vulcanization shaping with other rubber smoothly so as to prepare the rubber keypad containing electric contact, without causing quality problems like excessive glue and poor adhesion during heat vulcanization adhesion and heat vulcanization shaping.

A patent document with a patent application number of 200580045811.2 discloses a "Flat Primary Battery with Gold-plated Terminal Contact", which may be applied to, for example, a digital camera. The battery may have a contact containing a lithium anode and a low resistance. The anode and a cathode may present a spirally-crimped sheet form with a baffle therebetween. External anode and cathode contacts are plated by gold so as to improve the contact resistance. Although the electric contact according to the present invention has small resistance, the performance thereof for resisting sparks produced by voltage is not ideal since a melting temperature of gold is poorer than that of tungsten, molybdenum and other refractory metals. Moreover, the expensive price of gold also limits the application range of the electric contact.

A patent document with a patent application number of 201020143455.6 discloses a "Nickel-plated Tungsten Contact", which belongs to the technical field of basic appliance elements, and aims at solving the problem that the existing tungsten contact is easy to be oxidized to affect the electrical conductivity. In the prior art, the existing tungsten contact is mainly prepared by using pure copper as a solder to perform fusion welding on a rivet type seated nail and a tungsten plate. In this patent, an outer surface of the tungsten contact welding on the seated nail and the tungsten plate is enclosed and connected with a nickel-plate layer as the nickel-plated tungsten contact. The nickel-plated tungsten contact has a simple and practical structure and stable electrical conductivity, is durable in use, and is applicable to cars, motorcycles, electric horn and other electrical appliances. The contact of the patent uses the tungsten plate plus the nickel-plated layer, while the arc ablation resistance of nickel is low, so that the contact is not suitable for a relatively harsh occasion needing a higher working current or voltage. Our test shows that the nickel is served as a switch contact connects or disconnects (switches on or off) with the gold-plated contact. At a room temperature, but when the working current is 300 mA, the switching time is about 4000, then the contact resistance of the switch is significantly increased, or even to completely disconnect the circuit.

A U.S. Pat. No. 4,019,910 discloses to prepare a electroless nickel alloy plating bath. The nickel alloys contains boron or phosphorus, and one or more metals selected from tin, tungsten, molybdenum or copper. The electroless plating bath contains an ester complex obtained by reacting inorganic acid with polyhydric acid or alcohol, such as diboron ester, tungstate ester or molybdate ester of glucoheptonic acid. The nickel alloy is mainly constituted by nickel, and the nickel content is generally within the range of about 60% to about 95% by weight. The alloy has excellent mechanical property and corrosion resistance, and some alloys such as phosphorus-containing nickel alloys, in particular nickel-phosphorus-tin-copper alloys, have non-magnetic or non-ferromagnetic property. The polymetallic nickel alloy disclosed by the invention contains a relatively high content of boron or phosphorus. In the case of using as a contact material, the relatively large amount of boron or phosphorus will affect the initial resistance of the contact. Our tests show that, pure nickel, nickel alloy with high content of nickel (such as nickel-copper alloy or monel alloy, nickel-chromium alloy, etc.), nickel-containing stainless steel, or electroless nickel alloy using nickel as the main component, if serving as the contact of the switch, have poor arc resistance and low service life of switch.

A US patent application 20090088511 discloses an electroless plating solution used for selectively forming a cobalt-based alloy protective film on an exposed copper wire. The electroless plating solution includes a cobalt ion and another metal ion (tungsten and/or molybdenum), a chelating agent, a reducing agent, a specific surface active agent and a tetramethylammonium hydroxide. The use of the bath disclosed in this invention does not require the use of a copper seed layer (e.g., a palladium layer) prior to electroless plating. The protective film has the ability of anti-diffusion and anti-electromigration. However, this protective film, due to the high content of cobalt, is relatively hard and brittle. In addition, due to the arc, the cobalt-based alloy is very easy to produce oxides of cobalt and lead to increased surface resistance. The arc ablation resistance of this protective film is not good, so that this protective film is not suitable for manufacturing electrical contacts or contacts.

The invention with a U.S. Pat. No. 6,821,324 describes an aqueous bath for the chemical deposition of cobalt tungsten phosphorus containing cobalt chloride hexahydrate, soluble tungsten ion source from tungsten trioxide ($WO_3$) or phosphotungstic acid [H3P $(W_3O_{10})_4$], and a phosphorus-containing reducing agent, free from alkali metal ions and alkaline earth metal ions, and the obtained deposited film is oxygen-free and has a low resistivity. Such deposited films can be used as capping layers or barrier layers in products such as semiconductor chips, very large scale integration (VLSI) products, jewelry, nuts and screws, magnetic materials, wings, advanced materials and automotive components to prevent interlayer metal diffusion and migration. A small variety of raw materials is selected for the plating bath described in this invention. Since the plating bath does not contain alkali metal ions and alkaline earth metal ions, the concentration of tungsten ions in the plating solution is low (particularly when tungsten trioxide is used as the raw material), the tungsten content in the formed cobalt-tungsten-phosphorus deposited film is difficult to be adjusted, and a deposited film having a high tungsten content is difficult to obtain. The bath described in this invention can be deposited on substrates such as silicon, silicon dioxide, jewels, magnetic materials and metals, without selectivity to the substrate. In addition, the temperature of the switching arc can reach 6000° C., while in the existence of oxygen, when being heated to above 300° C. cobalt is oxidized to produce CoO or $Co_3O_4$. The alloy with cobalt as the main component has poor arc ablation resistance, and is not suitable as a contact material, so few cobalt alloy electrical contacts or contacts are found in industry.

The invention with a U.S. Pat. No. 6,797,312 describes a plating solution containing no alkali metal is used for forming a cobalt-tungsten alloy. The plating solution can be formulated without the use of tetramethylammonium hydroxide. Prior to depositing cobalt-tungsten metal alloy onto the substrate a catalyst such as palladium catalyst is not used for pre-treating the substrate, and the plating solution can be used for obtaining the deposited cobalt-tungsten alloy layer. The cobalt-tungsten alloy contains a lot of cobalt element, not resisting switch arc ablation. The alloy of this invention also does not relate to how to carry out selective chemical deposition.

The invention with an application patent number 201110193369.5 of the inventor provides a "Pitted-surface metal and rubber composite conductive particle" which is formed by adhering a metal surface layer to a rubber matrix or slitting after adhesion. The metal surface layer is a pitted surface and has concave pits or convex points or both the two; the concave pits or convex points are formed on an outer surface, or an inner surface of the metal surface layer, or both the outer surface and the inner surface; the depths of the concave pits are smaller than the thickness of the metal surface layer; and the heights of the convex points are no less than one tenth of the thickness of the metal surface layer. The metal surface layer is made of metal or alloy, the outer surface can be plated with gold, silver, copper or nickel; the rubber base is silicone rubber or polyurethane rubber; a bonding layer may be between the metal surface layer and the rubber base, and the bonding layer is a heat curing adhesion agent, a primer or a material the same as the rubber base. Aids such as a coupling agent can be coated on the inner surface of the metal surface layer. The metal surface layer of the invention has high strength and stable conductivity of electricity, the adhesion layer has high strength, and the rubber matrix has sufficient elasticity. The invention does not provide a solution to the problems of arc ablation resistance of the conductive particles. The present invention also does not propose a specific method of obtaining one or more plated layers on the outer surface of the metal surface layer. In the present invention, the pitted skin is plated with precious metals such as gold and silver. Since the surface area is large, the amount of the precious metal is large and the cost is high.

It is well known that a melting point of tungsten in all pure metals is the maximum of 3410° C. A vapor pressure of Tungsten is very low, and an evaporation rate is relatively slow. A chemical property of tungsten is very stable. Tungsten does not react with the air and water at a room temperature. In case of not heating, hydrochloric acid, sulfuric acid, nitric acid, hydrofluoric acid and aqua regia in any concentration have no effect on tungsten. Alkaline solution also has no effect on tungsten. Tungsten is also a material having a relatively small resistivity and better electrical conductivity. In a variety of pure metals, the resistivity of tungsten is greater than silver, copper, gold, aluminum and molybdenum, but less than zinc, nickel, cadmium, palladium, iron, platinum, tin, lead, antimony, titanium, and mercury. Tungsten as the contact material is conducive to reducing the contact resistance of the contact. However, the hardness of the tungsten or tungsten alloy is very high, and it is difficult to obtain tungsten or tungsten alloy flake with a small thickness (particularly, a tungsten alloy flake having a thickness of smaller than 0.05 mm) by a mechanical pressing or powder metallurgic method. If the tungsten alloy flake is used directly in the production of metal contacts, the cost of the raw materials of the metal contacts will be increased, and it is difficult to cut or punch due to the high hardness of tungsten or tungsten alloy. Due to the significant difference between tungsten and other metal properties, there is no mature and widely used application technology in electronic products, especially in contacts.

The present invention will disclose an arc-ablation resistant tungsten alloy switch contact and preparation method thereof. Because such contact contains the rubber layer, the contact may perform heat vulcanization adhesion and heat vulcanization shaping with the rubber, thus preparing a rubber keypad having an arc-ablation resistant contact.

SUMMARY

The first object of the invention is to provide an arc-ablation resistant tungsten alloy switch contact having low manufacturing cost and large on-current by overcoming the defects of higher cost and low arc-ablation resistance of conventional gold-plated, silver-based or silver-plated switch contacts, or by overcoming the defects of worse arc-ablation resistance and shorter service life of copper-based, tin-based, nickel-based or stainless steel contacts having lower cost.

First technical solution: the present invention provides an arc-ablation resistant tungsten alloy switch contact, wherein the switch contact is a layered complex having three layers of layered structures, a first layer of which is a hydrophobic rubber layer having a thickness of 0.1-10 mm, a second layer of which is a sheet metal layer having a thickness of 0.01-2.0 mm, and a third layer is a tungsten alloy plated layer having a thickness of $2\times10^{-5}$-0.02 mm; wherein the third layer of tungsten alloy plated layer is formed by dipping a complex of the first layer and the second layer in an electroless plating solution, and depositing a tungsten alloy on the surface of the second layer in the complex of the first layer and the second layer by a chemical deposition method, the tungsten alloy plated layer contains a tungsten element having a weight ratio greater than 30%, such transition metal elements as iron, cobalt, nickel, copper or manganese having a weight ratio of 0-70%, or such main group elements as tin, stibium, lead and bismuth.

The ions of such transition metal elements as nickel, cobalt, copper and manganese are added to the tungsten alloy plating solution in order to adhere the plating layer to the metal substrate firmly and then to accelerate the rate of chemical deposition. The ions of tin, antimony, lead or bismuth and other elements can also be added into the plating solution, so that the plating layer obtains the specific performance. For example, a small amount of stannous ions is added into the plating bath, or stannous ions, antimony ions and lead ions are added into the plating bath, so that the hardness of the plated layer may be reduced. Due to the use of phosphorus-containing or boron-containing reducing agent, a small amount of phosphorus may also be deposited in the plated layer. However, due to the high content of phosphorus and boron in the plated layer, the initial surface resistance of the plated layer will be increased. Therefore, measures should be taken to control the concentration of reducing agent in the plating bath and the temperature of the plating bath to control the content of phosphorus and boron in the plated layer.

The reasons for using the tungsten alloy plated layer as the outermost layer is that: the metal tungsten has stable chemical property in the atmosphere, and thus is a metal having a high melting point, which has a very low vapor pressure and good resistance to arc-ablation performance. Moreover, the electrical conductivity of tungsten is higher than the great majority of metals. Therefore, such contact can pass or bear a greater current, and thus has a longer service life.

In general, the stronger the hydrophobicity of the rubber material used is, the more favorable is the deposition of the tungsten alloy on the metal surface in the rubber-metal layered complex used in the present invention rather than deposition on the surface of the rubber material. A hydrophilic rubber, a rubber material containing a surfactant or an anti-static agent, a rubber material containing a large amount of hydrophilic or water-absorbent filler and is not suitable to be used in the present invention. If these rubber materials are used, the tungsten alloy plating layer is also deposited on these rubber material during electroless plating.

As an optimization, the hydrophobic rubber layer is composed of a rubber material enabling a water contact angle on a rubber surface to be greater than 65 degrees since contents of carboxyl, hydroxyl radical, carbonyl, amino group, acylamino, nitrile group, nitro, halogeno, sulfhydryl group, sulfonate and benzene sulfonate are low; or, the hydrophobic rubber layer is composed of a rubber material enabling the water contact angle on the rubber surface to be greater than 65 degrees since the rubber contains no or contains a small amount of hydrophilic filler or additive.

As an optimization, the hydrophobic rubber layer is prepared by nonpolar or weak polar rubber; and is preferably prepared by ethylene propylene diene monomer, methylvinylsiloxane gum or polymethylvinylphenylsiloxane gum.

The ethylene propylene diene monomer, methylvinylsiloxane gum and polymethylvinylphenylsiloxane gum are nonpolar rubber, which have strong hydrophoby and good weather resisting property at the same time, and can keep excellent elasticity for a long term in atmosphere; therefore, the ethylene propylene diene monomer, methylvinylsiloxane gum and polymethylvinylphenylsiloxane gum are materials preferably selected for the hydrophobic rubber layer. Polar rubber like nitrile rubber and hydrogenated nitrile rubber with a high nitrile group content, carboxy-terminated butadiene nitrile liquid rubber, chlorosulfonated polyethylene rubber, epichloro-hydrin rubber, acrylic rubber, urethane rubber, and hydrophilic rubber (like hydrophilic silicone rubber), water swelling rubber and other materials have big polarity or contain a great amount of hydrophilic substances, so that the surface hydrophoby of these materials is weak. These materials are in the electroless plating solution containing a soluble tungsten compound, and the tungsten alloy plated layer will be deposited on the surface of these materials.

The hydrophobic rubber in the hydrophobic rubber layer has water repellency, and water cannot be spread on the surface of the hydrophobic rubber. To implement selective chemical deposition of tungsten alloy on the metal material, the hydrophoby of the rubber material in the complex of the hydrophobic rubber layer in the first layer and the sheet metal in the second layer is the higher, the better. To make the alloy deposited on the hydrophobic rubber layer in the first layer to an amount that can be ignored when performing chemical deposition by the plating solution, the water contact angle of the rubber substrate needs to be greater than 65 degrees. The term "selective chemical deposition" as used herein refers to a tungsten alloy plated layer which is selectively deposited on a metal material but not on a rubber material. The carboxyl, hydroxyl radical, carbonyl, amino group, acylamino, nitrile group, nitro, halogeno, sulfhydryl group, sulfonate and benzene sulfonate on the rubber molecular chain will greatly increase the polarity and hydrophily of the rubber. Particularly, the carboxyl, hydroxyl radical, sulfonate and benzene sulfonate will greatly increase the polarity and hydrophily of the rubber. If a carboxylic rubber having strong hydrophily is used in the complex of rubber and metal, then the chemical deposition will occur on both the surface of metal material and that of the rubber material in the meanwhile. If a tungsten alloy deposit layer is formed on the rubber material, not only the electroless plating bath is wasted, but also the heat vulcanization adhesion or thermoplastic adhesion of the rubber material with other rubber material is unfavorable, while the heat vulcanization adhesion or thermoplastic adhesion is required in subsequent processing. The first layer of hydrophobic rubber layer is to perform the heat vulcanization adhesion or thermoplastic adhesion to the other rubbers, thereby preparing the rubber keypad containing contact.

Therefore, it is necessary to limit the content of these polar groups in the rubber substrate, so as to obtain the tungsten alloy chemical deposition having excellent selectivity. In order to obtain the best selective chemical deposition, the rubber substrate cannot contain these groups. For the same reason, the body or surface of rubber material contains no or contains a small amount of hydrophilic filler, additives or surfactants, but also is conducive to the selective chemical deposition.

The ethylene propylene diene monomer, methylvinylsiloxane gum and polymethylvinylphenylsiloxane gum are nonpolar or weak polar rubber materials, which have strong hydrophoby, and thus are suitable for compositing with the sheet metal to prepare the layered complex. When the electroless plating bath is used for electroless plating, the chemical deposition does not occur on the rubber layer.

As an optimization: the second layer of sheet metal layer is a metal sheet having a convex point or a concave point, a metal sheet having a convex line or a concave line, a metal sheet having a convex surface or a concave surface, a metal sheet having a small hole with an area less than 1 mm2, a metal gauze, metal foams or a metal fiber sintered felt, so as to have higher contact pressure intensity with the contact on the PCB, and better conductivity; the metal material is magnesium, aluminum, titanium, chromium, manganese, ferrum, cobalt, nickel, copper, zinc, niobium, molybdenum, silver, tin, aurum, or an alloy containing the elements; and the sheet metal layer is a single metal material or composited by different metal materials in a layered manner. The metal or alloy, such as stainless steel or nickel alloy, having stable chemical property in the atmosphere, higher electrical conductivity and lower price is preferred.

As an optimization, the sheet metal of the second layer is composed of a stainless steel sheet, a copper or copper alloy sheet, and a nickel or nickel alloy sheet having a thickness of 0.01-1.0 mm, and a pure nickel layer or a nickel alloy layer having a thickness of 0.01-10 m is plated on one side or two sides of the stainless steel sheet, the copper or copper alloy sheet and the nickel or nickel alloy sheet; and the nickel alloy layer on the stainless steel sheet, the copper or copper alloy sheet, and the nickel or nickel alloy sheet is prepared by vacuum plating, electroplating or chemical plating.

Plating one pure nickel layer or nickel alloy layer on the stainless steel, the copper or copper alloy sheet, and the nickel or nickel alloy sheet may improve the adhesive strength between the sheet metal and the tungsten alloy plated layer, and avoid the tungsten alloy plated layer from falling out during the use process of the contact. Especially for copper and copper alloy sheets, it is desirable to be plate a thin layer of pure nickel layer or nickel alloy on both surface of the copper an copper alloy sheets prior to the chemical deposition of tungsten alloy plated layer to improve the oxidation and chemical resistance of the copper and copper alloy.

The selected stainless steel is common stainless steel, acid-resistant steel, or special stainless steel added with molybdenum element so as to improve atmospheric corrosion resistance, in particular, corrosion resistance of chloride-containing atmosphere.

The thickness of the sheet metal should not be too thin. If the thickness of the sheet metal of the second layer is lower than 0.01 mm, the third layer of tungsten alloy plated layer cannot be supported preferably, and is easy to break before, during or after the processing of being composited with the rubber. If the second layer of sheet metal is too thick, the whole hardness of the contact will be increased, and the metal material is wasted in the meanwhile. Therefore, the thickness of the sheet metal should be no more than 1.0 mm.

To prepare the hydrophobic rubber layer in the first layer and the sheet metal in the second layer into a layered complex in advance is to facilitate using the layered complex as a contact to prepare a rubber keypad. Heat vulcanization adhesion or thermoplastic adhesion can be directly conducted between the hydrophobic rubber on the layered complex and other rubber to form a rubber keypad. If the rubber keypad is formed without performing heat vulcanization adhesion and heat vulcanization shaping or thermoplastic adhesion and thermoplastic shaping between the sheet metal of the rubber layer and other rubber, an excessive rubber, poor adhesion and other phenomena will occur during moulding. The so-called excessive rubber phenomenon means that the rubber overflows to the front side of the contact during moulding, thus affecting the electrical conductivity of the contact. The excessive rubber phenomenon on the contact is unacceptable from the aspect of the quality of the contact.

The second object of the invention is to provide a preparation method of the arc-ablation resistant tungsten alloy switch contact.

Second technical solution: a preparation method of the arc-ablation resistant tungsten alloy switch contact comprises the following steps of (1) treatment of sheet metal: the sheet metal being a stainless steel sheet, a copper or copper alloy sheet, and a nickel or nickel alloy sheet having a thickness of 0.01-1.0 mm; using a cleaning agent and an organic solvent to deoil and clean the sheet metal; or mechanically roughing a surface of the sheet metal through sand blasting and polishing; or processing the sheet metal through chemical etching into concave pits or convex points having a diameter less than 1 mm; or plating a pure nickel layer or a nickel alloy layer having a thickness of 0.1-10 μm on one side or two side of the sheet metal by electroplating or chemical plating; then using the cleaning agent and the organic solvent to deoil and clean the sheet metal obtained;

(2) adhesion treatment of hydrophobic rubber and sheet metal: adhering a hydrophobic rubber onto the sheet metal plated with a prime coat or an adhesion promoter through heat vulcanization adhesion and heat vulcanization shaping, to form a layered composite sheet; or adhering the hydrophobic rubber with self-adhesiveness on a sheet metal plated with a prime coat or not plated with a prime coat through heat vulcanization shaping, to form a layered composite sheet;

(3) cutting treatment: separating or punching the composite sheet in the step above into a cylinder comprising a hydrophobic rubber layer and a sheet metal layer and having a diameter of 2-10 mm; or separating or punching the composite sheet in the step above into an object having a cross section in a shape of ellipse, polygon, crisscross, star or crescent or any combinations thereof; using a basic cleaning liquid to wash the object for about 5 min, washing the object by water, then using 5% hydrochloric acid to clean the object for about 3 min, using deionized water to clean the object cleanly, and then draining off the object;

The purpose of cleaning with 5% hydrochloric acid is to remove part of oxide on the surface of the metal substrate, thereby activating the surface of the metal substrate, and enhancing the adhesive strength between the metal substrate and the tungsten alloy plated layer. It is also feasible to use other cleaning and acid activation methods.

(4) preparation of tungsten alloy plated layer: dipping the cylinder or the object above in a chemical plating bath containing a soluble tungsten compound and stirring to form a tungsten alloy plated layer on a metal surface of the cylinder or the object using a method of chemical plating; or, putting the cylinder above into a roller for a chemical plating bath containing a soluble tungsten compound to make the roller rotate and form a tungsten alloy plated layer on the metal surface of the cylinder using a method of chemical plating;

the plating bath containing 40-125 g/L soluble tungsten compound, 0-60 g/L soluble compound of a transition metal like ferrum, nickel, cobalt, copper or manganese or any combination of the compounds, 0-30 g/L soluble compound of tin, stibium, lead or bismuth or any combination of the compounds, 20-100 g/L reducing agent, 30-150 g/L complexing agent, 20-100 g/L pH adjuster, 0.1-1 g/L stabilizer, 0.1-1 g/L surfactant, and 0-50 g/L brightener or roughness adjuster; Sodium fluoride may be selected as an accelerator. Sodium fluoride may be not only used as the accelerator, but also increase the brightness of the plated layer in the meanwhile.

Sodium hypophosphite is selected as the reducing agent preferably. When the sodium hypophosphite is adopted as the reducing agent, a temperature for chemical plating adopted on the tungsten alloy plated layer is 65-85 □, the time is 30-300 min, and a pH value of the plating bath is 8.0-10.0.

(5) cleaning and drying: taking out the plated tungsten, using distilled water or deionized water to clean the object for multiple times, then draining the object off, and putting the object in a 75° C. constant temperature drying oven to dry, thus obtaining a switch contact with a metal surface layer coated with a tungsten alloy.

As an optimization: a temperature for chemical plating adopted on the tungsten alloy plated layer is 70-80° C., the time is 100-200 min, and a pH value of the plating bath is 8.5-9.0; the plating bath contains strong-acid weak-base salt having a pH buffering capacity; the pH regulator is one or more of sodium hydroxide, potassium hydroxide, sodium carbonate, sodium acetate, ammonia water, sodium pyrophosphate or potassium pyrophosphate or the like; and ammonia or sodium hydroxide solution is preferably used to regulate the pH value of the plating bath.

The timing of electroless plating is related to the performance requirements for arc-ablation resistance or service life of switch products. The longer the time of the electroless plating is, the thicker the tungsten alloy plated layer is deposited on the metal substrate. The thicker tungsten alloy plated layer is conducive to the switching arc resistance of the contacts. But the electroless plating time is not the longer the better. The too long electroless plating time results in low production efficiency. In addition, and weakly-alkaline electroless plating bath may damage to the adhesive strength between the first layer of hydrophobic rubber layer and the second layer of sheet metal layer, and even causes a delaminating phenomenon. As an optimization, if the switching time at a 500 mA on-current is required to be 10,000 or more, the time for the tungsten alloy plated layer using the electroless plating is 200 min.

In the present invention, the soluble tungsten compound is one or more of potassium tungstate, sodium tungstate, ammonium tungstate, ammonium bitungstate, ammonium tetratungstate, ammonium heptatungstate, ammonium octatungstate. Tungsten trioxide or tungstic acid may also be used. Although tungsten trioxide or tungstic acid is insoluble in neutral water, it is soluble in alkaline water. When tungsten trioxide or tungstic acid is used, an alkaline solution of sodium hydroxide or ammonia water having pH of greater than 12 needs to be used firstly to dissolve it, and then the dissolved tungsten acid or tungsten trioxide is used for preparing the electroless plating bath. The sodium tungstate dissolved in water easily and having a lower price is preferably selected to prepare the electroless plating bath.

The compound of the soluble transition metal iron, cobalt, nickel, copper or manganese is one or more of ferrous sulfate, ferrous ammonium sulfate, cobalt sulfate, cobalt chloride, cobalt nitrate, cobalt ammonium sulfate, basic cobaltous carbonate, cobalt sulfamate, cobaltous acetate, cobalt oxalate, nickel sulfate, nickel chloride, nickel nitrate, nickel ammonium sulfate, basic nickel carbonate, nickel aminosulfonate, nickel acetate, nickel hypophosphite, nickel hypophosphite hexahydrate, nickel hydroxide, copper sulfate, copper chloride, copper nitrate, copper hydroxide carbonate, copper acetate, and manganese sulfate or manganese chloride. When nickel hydroxide is used, it is firstly dissolved with ammonia water. We found that during the course of plating the tungsten alloy, nickel sulfate is composited with basic nickel carbonate in the electroplating plating bath as a precursor of nickel, so that the plated tungsten alloy layer has a relatively bright silver-white, and the surface resistance of the obtained tungsten alloy plated layer is low.

Compounds of soluble transition metal elements other than iron, cobalt, nickel, copper or manganese, and compounds of soluble main group elements such as tin compounds, antimony compounds, bismuth compounds and lead compounds may be added into the plating bath, but it is to be noted that these compounds have selective influences on the substrate deposited by electroless plating. In addition, attention should be paid to the physiological toxicity, environmental toxicity and hazardous properties of these compounds. For example, soluble lead compounds that are harmful to the human body and the environment should be minimized or eliminated. Although silver is an element commonly used in electrical contacts or contacts, it is not recommended to add such soluble silver compounds as silver nitrate into the tungsten alloy plating bath. Since we found in the experiment that after a certain amount of silver nitrate (e.g., 5 g/L) was added into the tungsten alloy plating solution, the chemical deposition occurred in electroless plating the layered complex of the first layer of the hydrophobic rubber layer and the second layer of the sheet metal layer occurs in both the second layer of the sheet metal layer and the first layer of hydrophobic rubber layer, so that the substrate is not selected by the chemical deposition. When the deposition time is long enough, it is clearly seen by the naked eye that a layer of grayish black or silvery white is deposited on both the hydrophobic rubber layer and the sheet metal layer. X-ray fluorescence spectroscopy revealed that both the surface of the sheet metal layer and the surface of the hydrophobic rubber layer contained a large amount of silver. After the addition of silver nitrate was canceled by the same formulation, the chemical depositing layer is only generated on the metal surface of the sheet metal layer during electroless plating.

As an optimization: the reducing agent is one or more of sodium hypophosphite, sodium borohydride, alkylamine borane, or hydrazine. If boron hydride or aminoborane is used as a reducing agent, the tungsten alloy plated layer will contain a small amount of boron (mass fraction of up to 7%). If hydrazine is used as a reducing agent, the content of non-metal (phosphorus or boron) in the obtained plated layer is almost zero, but the metal content can reach more than 99%. If sodium hypophosphite is used as a reducing agent, the reducing agent has a very good cost performance, and its toxicity is low. When sodium hypophosphite is used as a reducing agent, phosphorus is jointly deposited with metal due to the precipitation of phosphorus, thus the plated layer still contains a small amount of phosphorus (mass faction up to 15%) besides tungsten and other metal elements. Phosphorus is detrimental to the electrical conductivity of the contacts, and may damage to the corrosion resistance of the tungsten alloy. Therefore, it is necessary to control the phosphorus content of the tungsten alloy. By controlling the concentration of sodium hypophosphite, the concentration of complexing agent, pH value and other measures, the phosphorus content in the coating may be controlled. A dense, non-porous tungsten alloy plated layer may be obtained by controlling the phosphorus content. By using sodium hypophosphite as a reducing agent, the contact resistance between the tungsten alloy plated layer and the tungsten alloy plated layer obtained was smaller than that between pure nickel of 99.5% and pure nickel of 99.5%, and the obtained plated layer may significantly improve the switching arc resistance of the metal substrate.

As an optimization, the complexing agent is one or more of sodium citrate, ammonium citrate, sodium tartrate, potassium sodium tartrate, sodium salt of ethylene diamine tetraacetic acid (EDTA) and sodium salt of ethylene tetra amine tetraacetic acid. The complexing agent plays a role in controlling the concentration of free metal ions supplied for reaction, improving the stability of the plating bath, extending the service life of the plating bath, and improving the quality of the plated layer. The complexing agent affects the deposition rate, phosphorus content and corrosion resistance, etc.

The pH regulator is one or more of sodium hydroxide, potassium hydroxide, sodium carbonate, sodium bicarbonate, sodium acetate, ammonium sulfate, ammonia hydroxide, sodium pyrophosphate, or potassium pyrophosphate or the like; and ammonia water or sodium hydroxide solution is preferably used to regulate the pH value of the plating bath. In this way, a tungsten alloy plated layer with stronger, more stable adhesion and better quality may be obtained. The longer the time of the electroless plating is, the thicker the tungsten alloy plated layer is deposited on the metal substrate. The thicker tungsten alloy plated layer is conducive to the switching arc resistance of the contacts. But the electroless plating time is not the longer the better. The too long electroless plating time results in low production efficiency. In addition, and alkaline electroless plating bath may damage to the adhesive strength between the first layer of hydrophobic rubber layer and the second layer of sheet metal layer, and even causes a delaminating phenomenon. When sodium hypophosphite is used as a reducing agent, the pH value of the reducing agent cannot be greater than 12. This is because the excessively high pH accelerates the deposition rate, but the adhesive force between the plated layer or the deposited layer and the metal substrate becomes weak, thus making the color of the plated layer or the deposited layer darker, or even black. Strong-acid weak-base salt or strong-base weak-acid salt may be added in the plating bath as a pH buffering agent of the plating bath.

As an optimization: without regard to solar and luster, the stabilizer is a mixture of one or more of potassium iodide, potassium iodate, benzotriazole, 4,5-dithiaoctane-1,8-disulfonate, 3-mercapto-1-propanesulfonate, sodium thiosulfate and thiourea. The brightener (or surface roughness adjuster) may be one or more of commercially available commercialized chemical plating brightener. Without regard to solar and luster, the stabilizer is preferably sodium thiosulfate, thiourea or a mixture of the two, so that the tungsten alloy plated layer has excellent metallic luster in the meanwhile. The stabilizer plays a role in inhibiting the autocatalytic reaction in the electroless plating process to stabilize the plating bath, preventing the intense autocatalytic reaction and preventing the formation of a large amount of phosphorus-containing ferrous metal powder. But the stabilizer is a poisoning agent for electroless plating, that is, decatalytic reaction, which cannot be overused, and needs to control the amount of its use in the plating bath, so as not to affect the efficiency of electroless plating.

As an optimization: the plating bath adopted in the chemical plating also contains 0.1-1 g/L surfactant; and the surfactant is one or more surfactants of dodecyl benzene sulfonate, lauryl sulfate and sodium n-octyl sulfate; and is preferably sodium dodecyl sulfate or sodium dodecylbenzene sulfonate. Addition of some surfactants can help spill the gas on the plating part surface, and reduces the porosity of the plated layer, so that the coating is dense, thereby increasing the arc resistance of the plated layer.

As an optimization, the plating bath used for electroless plating also contains brightener or roughness adjuster up to 50 g/L; and the brightener or roughness adjuster is formaldehyde, acetaldehyde, β-naphthol, 2-methyl aniline-aldehyde condensates, benzalacetone, cuminaldehyde, benzophenone, chlorobenzaldehyde, peregal, schiff base, butynediol, propiolic alcohol, 1-diethylaminoprop-2-yne, propynol ethoxylate, saccharin, sodium benzosulfimide, sodium vinylsulfonate, sodium proparagylsulfonate, pyridine-2-hydroxypropanesulfonate inner salt, alkylphenol polyoxyethylene or commercially available commercialized electroplating or chemical plating brightener. A silver bright refractory metal alloy plated layer may be obtained by adding the brightener. The efficiency of brightener may be improved and the amount of brightness may be reduced by compounding different brighteners.

In the present invention, when the complex of the hydrophobic rubber layer and the sheet metal layer is chemically plated by the plating bath, the tungsten alloy plated layer may be deposited on the metal surface. The X-ray fluorescence spectrometer (XRF) was used to detect the tungsten content of the metal surface. It was found a tungsten signal detected on the metal surface became stronger with the increase of electroless plating time in the same plating bath.

The tungsten signal is getting stronger, which means that tungsten alloy plated layer becomes thicker following the electroless plating time. However, the tungsten signal detected on the surface of the hydrophobic rubber is substantially zero even if the electroless plating time is as long as 300 min.

Advantageous effects: in the present invention, a layer of tungsten-containing alloy is selectively plated on the layered complex of the hydrophobic rubber layer and the sheet metal layer by electroless plating, thereby effectively improving the electrical conductivity and the switching arc-ablation resistance of the sheet metal. The contacts plated with a tungsten alloy layer made of stainless steel sheets (such as SS304 stainless steel sheets), nickel sheets (such as N6 nickel sheets), nickel alloy sheets (such as NCu30 nickel-copper alloy sheets) are contacted with the gold-plated contacts on a printed circuit board (PCB). The contact resistance between the contacts is smaller than that between the similar contact not plated with tungsten alloy and that on the PCB, so that the contacts plated with tungsten alloy have better conduction performance. After electrifying a 300 mA direct current between the contact prepared by stainless steel sheet or nickel sheet not plated with tungsten alloy and the PCB gold-plated contact, and switching about 4000 times at a room temperature, due to the existence of arc-ablation during switching, the contact resistance between the small wafer and the PCB gold-plated contact is significantly increased (from about 1Ω To 100Ω Or more, or even non-conductive); however, in the same circuit conditions, after electrifying a 500 mA direct current between the similar contact plated with tungsten alloy and the PCB contact, and switching about 3000 times, the contact resistance between the contact and the PCB contact is still below 1Ω.

Compared with the switch contacts plated with gold, platinum or silver, this tungsten-plated contact may pass through or bear the larger current, so that it has better arc-ablation resistance. Moreover, the price of metal tungsten is much lower than gold, platinum or silver.

By adjusting the composition of the plating bath and the time and temperature of the electroless plating, the obtained contacts may have an appearance such as color and luster similar to gold, silver, white silver, steel, or certain titanium nitride. The tungsten alloy contacts in the present invention comprise a hydrophobic rubber layer having the property of being susceptible to thermal vulcanization adhesion and shaping with rubber to produce contact-containing rubber keypad products The product of the invention is suitable for various kinds of high-grade places, and is particularly suitable for making switch contacts which need large electric current (greater than 50 mA) under the button in the electric equipment such as automobiles, electric tools and game machines, etc.

DETAILED DESCRIPTION

Figure 1:
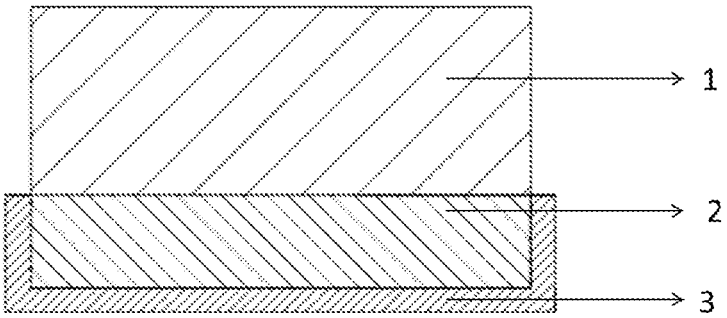
FIG. 1 is a schematic diagram of a sectional structure of the present invention; in the figure: 1 refers to rubber layer; 2 refers to sheet metal layer; and 3 refers to tungsten alloy plated layer.

The present invention will be further described in details hereunder with reference to the specific embodiments.

Embodiment 1:

An embodiment of preparing a contact of a tungsten alloy plated layer is as follows.

The compositions of the plating bath were as follows: 100 g/L sodium tungstate, 35 g/L sodium hypophosphite, 50 g/L sodium citrate, 30 g/L potassium sodium tartrate, 30 g/L ammonium sulfate, 24 g/L sodium pyrophosphate, 40 mg/L potassium iodate, 32 mg/L sodium thiosulfate, and 1 g/L sodium dodecyl sulfate. Proper aqueous ammonia was added to make the pH of the plating bath within 8.5-9.5.

Process route was as follows:

The zinc-cupro-nickel sheet having a thickness of 0.1 mm, an HV hardness of 120 to 180, and a copper content of about 55% was used as the metal substrate to prepare the sheet metal layer 2. The reason for choosing zinc-cupro-nickel was that the zinc-cupro-nickel has excellent comprehensive mechanical properties, excellent corrosion resistance, and good hot and cold shaping property, and is suitable for manufacturing various elastic elements. The smooth zinc-cupro-nickel sheet was mechanically rolled into a sheet having fine rippers by a mechanical method, which had a crest height of 0.2 mm and a peak pitch of 0.4 mm. The sheet was cleaned and deoiled by industrial alcohol, then a basic cleaning liquid having a pH value around 9 was used to further clean and deoil the sheet under a temperature 60° C., then the sheet was washed by water, washed by 12.5% sulfuric acid solution under a temperature of 50 to 70° C. for 1 min, and washed by water. Then a nickel layer having a thickness of 2.5-5.0 μm was plated on both sides of the zinc-cupro-nickel sheet having fine ripples by electroless plating. The nickel-plated zinc-cupro-nickel sheet having fine ripples was cleaned up by deionized water, and blow-dried by cold air.

Polymethylvinylphenylsiloxane gum (for example, Elastosil® R 401/60 produced by Wacker Chemie AG), vinyl tris-tert-butyl peroxy silane (VTPS) and dicumyl peroxide (DCP) were uniformly mixed by an open mill. The content of the VTPS in a rubber compound was 1%, and the content of the DCP in the rubber compound was 0.5%. VTPS was an unstable coupling agent containing a peroxide component, which not only can crosslink silicone rubber containing vinyl but also can promote the bonding between the silicone rubber containing vinyl and metals.

Heat vulcanization adhesion and heat vulcanization shaping were performed between the zinc-cupro-nickel sheet having fine ripples and plated with nickel layer and the foregoing rubber compound under 165° C., wherein a curing time was 10 min, to form a layered composite sheet of zinc-cupro-nickel and silicone rubber having a thickness of 1.25 mm. A mold cavity of a mold for preparing the composite sheet has a Teflo coating on a surface of the mold cavity. The composite sheet was punched into a small wafer having a diameter of 5 mm. The small wafer was cleaned for various minutes by basic cleaning liquid, washed by water, then dip into 5% hydrochloric acid for 3 min, put into 10% dilute sulfuric acid for activation for 1 min, and then cleaned by distilled water or deionized water, and drained off.

500 small wafers above were put into 300 mL plating bath above under a temperature of 80° C. and stirred, taken out after 200 min, rinsed by distilled water or deionized water, drained off, and put into a 70° C. constant temperature drying oven to dry, thus obtaining small wafers with a sheet metal player 2 plated with tungsten alloy. During the process of chemical tungsten, attentions should be always paid to the change of the pH value, and the pH value of the solution should be controlled by ammonia water or sodium hydroxide solution in time, so as to make the pH value within 8.5 to 9.5. The thickness and density of the plated tungsten alloy were related to the time of the small wafers placed in the plating bath. The longer the deposition time was, the thicker the tungsten alloy plated layer 3 became. The tungsten alloy was deposited only on the surface of the stainless steel in the small wafer and rather than deposited on the surface of the rubber layer 1 in the small wafers as shown in FIG. 1.

Heat vulcanization adhesion was performed between the small wafer plated with tungsten alloy of the silicon-containing rubber layer and the silicone rubber (heat vulcanization adhesion was performed between the a silicone rubber face in the small wafer and other silicone rubber, wherein one face plated with tungsten alloy faced outwards), so that the small wafer might be used as the contact of the circuit switch in the rubber keypad. The contact was contacted with the gold-plated contact of the PCB. The contact resistance between the contacts was smaller than that between small wafer directly prepared by stainless steel sheet and the gold-plated contact of the PCB, and the small wafer plated with tungsten alloy had better conduction performance: after electrifying a 300 mA direct current between the small wafer made of stainless steel sheet and not plated with tungsten alloy plated layer 3 and the PCB gold-plated contact, and switching about 2000 times, due to the arc-ablation during switching on or off, the contact resistance between the small wafer and the PCB gold-plated contact was significantly increased (from about 1Ω to 100Ω or more, or even non-conductive condition during multiple tests); however, in the same circuit conditions, after electrifying a 300 mA direct current between the small wafer plated with tungsten alloy and the PCB contact, and switching about 1000 times, the contact resistance between the small wafer and the PCB gold-plated contact is still below 1Ω.

Embodiment 2:

An embodiment of preparing a contact containing the tungsten alloy plated layer is as follows.

The compositions of the plating bath were as follows: 90 g/L sodium tungstate, 10 g/L nickel sulfate, 16 g/L basic nickel carbonate, 25 g/L sodium hypophosphite, 50 g/L sodium citrate, 30 g/L potassium sodium tartrate, 30 g/L ammonium sulfate, 24 g/L sodium pyrophosphate, 40 mg/L potassium iodate, 32 mg/L sodium thiosulfate, 1 g/L sodium dodecyl sulfate, and 20 g/L sodium benzosulfimide. Proper aqueous ammonia is added to make the pH of the plating bath within 8.5-9.5.

Figure 2:
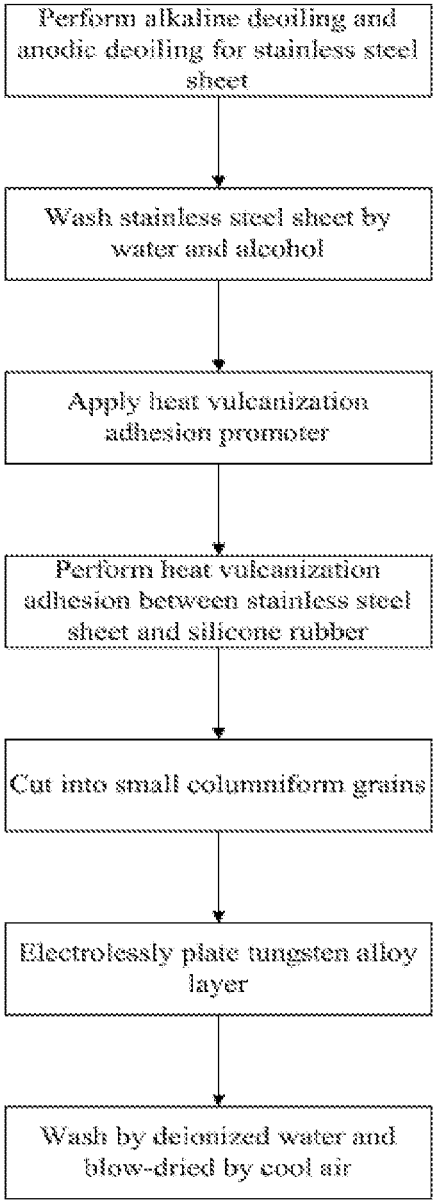
FIG. 2 is a process flow diagram of a preparation method of the present invention.

Process route was as follows:

As shown in FIG. 2, a flat stainless steel sheet (Model 304) having a thickness of 0.075 mm was subjected to alkaline deoiling and anodic deoiling, then washed by tap water and cleaned up by distilled water and alcohol, one surface of the sheet was subjected to a primer treatment by a rubber-metal adhesion agent (Megum 3270 produced by Rohm and Haas Company, U.S.A.), and then the heat vulcanization adhesion was performed between the surface treated with the primer and a methylvinyl silicone rubber (e.g., KE 951U produced by Shin-Etsu Chemical Co., Japan) to form a stainless steel-silicone rubber composite sheet having a thickness of 1.0 mm. The composite sheet was punched into a small wafer having a diameter of 5 mm.

The wafers were washed by basic cleaning liquid under a temperature of 70° C. for about 5 min, washed by water, then washed by 5% hydrochloric acid for 3 min, then cleaned by deionized water and drained off.

500 small wafers above were put into 300 mL plating bath above under a temperature of 80° C. and stirred, taken out after 240 min, rinsed by distilled water or deionized water, drained off, and blow-dried by cold air or put into a 700 constant temperature drying oven to dry, thus obtaining small wafers with a sheet metal player 2 plated with tungsten alloy. During the process of chemical tungsten, attentions should be always paid to the change of the pH value, and the pH value of the solution should be controlled by ammonia water or sodium hydroxide solution in time, so as to make the pH value within 8.5 to 9.5. The thickness of the plated tungsten alloy was related to the time of the small wafers placed in the plating bath. The longer the deposition time was, the thicker the tungsten alloy plated layer 3 became. The tungsten alloy was deposited only on the surface of the stainless steel in the small wafer and rather than deposited on the surface of the rubber layer 1 in the small wafers as shown in Figure.

Heat vulcanization adhesion was performed between the small wafer plated with tungsten alloy and the silicone rubber in a heating mould pressing mode (heat vulcanization adhesion was performed between the a silicone rubber face in the small wafer and other silicone rubber, wherein one face plated with tungsten-nickel alloy faced outwards), so that the small wafer might be used as the contact of the circuit switch in the rubber keypad. The contact was contacted with the gold-plated contact of the PCB. The contact resistance between the contacts was smaller than that between small wafer directly prepared by stainless steel sheet and the gold-plated contact of the PCB, and the small wafer plated with tungsten alloy had better conduction performance: after electrifying a 300 mA direct current between the small wafer made of stainless steel sheet and not plated with tungsten alloy plated layer 3 and the PCB gold-plated contact, and switching about 2000 times, due to the arc-ablation during switching on or off, the contact resistance between the small wafer and the PCB gold-plated contact was significantly increased (from about 1Ω to 100Ω or more, or even non-conductive condition during multiple tests); however, in the same circuit conditions, after electrifying a 500 mA direct current between the small wafer plated with tungsten alloy and the PCB contact, and switching about 2000 times, the contact resistance between the small wafer and the PCB gold-plated contact is still below 1Ω.

Embodiment 3:

A 400-mesh stainless steel plain net (the model of the stainless steel was 304) was used to replace the stainless steel sheet having fine ripples in embodiment 2, and the contact prepared using the process and the electroless plating bath in embodiment 2 also had lower contact resistance and preferable arc-ablation resistance.

A mesh of the 400-mesh stainless steel net was very small, and the silicone rubber will not penetrate through the mesh of the stainless steel net when molding the stainless steel net with the silicone rubber. If a stainless steel net with a small mesh number, for instance, a stainless steel net with a mesh below 80, was selected, a technical problem that the silicone rubber penetrated through the mesh of the stainless steel net during molding will occur. Therefore, a stainless steel net with a larger mesh number needs to be adopted for preparing a switch contact having a tungsten alloy plated layer 3.

Those having ordinary skills in the art may also make various improvements and polishing without departing from the principle of the invention, which shall all be deemed as the protection scope of the invention.

What is claimed is:

1. An arc-ablation resistant tungsten alloy switch contact, wherein the switch contact is a layered complex having a three-layer structure, comprising:

a first layer, which is a hydrophobic rubber layer composed of a vulcanized hydrophobic rubber material, and having a thickness of 0.1-10 mm;

a second layer, which is a sheet metal layer having a thickness of 0.01-1.0 mm and containing magnesium, aluminum, titanium, chromium, manganese, ferrum, cobalt, nickel, copper, zinc, niobium, molybdenum, silver, tin or aurum, wherein the hydrophobic rubber layer is adhered with self-adhesiveness directly to the sheet metal layer by heat vulcanization adhesion or by heat vulcanization shaping of the hydrophobic rubber material; and a third layer, which is a tungsten alloy plated layer having a thickness of $2*10^{-5}$-0.02 mm, wherein the tungsten alloy plated layer of the third layer is deposited on a surface of the second layer, and the tungsten alloy plated layer in the third layer contains no less than 30 weight % tungsten.

2. The arc-ablation resistant tungsten alloy switch contact according to claim 1, wherein the third layer is chemically deposited on the surface of the second layer.

3. The arc-ablation resistant tungsten alloy switch contact according to claim 1, wherein the hydrophobic rubber material enables a water contact angle on a rubber surface of the hydrophobic rubber layer to be greater than 65 degrees.

4. The arc-ablation resistant tungsten alloy switch contact according to claim 3, wherein the hydrophobic rubber layer is prepared from nonpolar or weak polar rubber.

5. The arc-ablation resistant tungsten alloy switch contact according to claim 4, wherein the hydrophobic rubber layer is an ethylene propylene diene monomer, methylvinylsiloxane gum or polymethylvinylphenylsiloxane gum.

6. The arc-ablation resistant tungsten alloy switch contact according to claim 1, wherein the sheet metal layer is a metal sheet having a convex point or a concave point, a metal sheet having a convex line or a concave line, a metal sheet having a convex surface or a concave surface, a metal sheet having a small hole with an area less than 1 $mm^2$, a metal gauze, metal foams or a metal fiber sintered felt; and wherein the sheet metal layer is a single metal material or composited by different metal materials in a layered manner.

7. The arc-ablation resistant tungsten alloy switch contact according to claim 1, wherein the sheet metal layer is a stainless steel sheet, a copper sheet, a copper alloy sheet, a nickel sheet, or a nickel alloy sheet having a thickness of 0.01-1.0 mm, and a pure nickel layer, a nickel alloy layer, a pure cobalt layer, or a cobalt alloy layer having a thickness of 0.1-10 μm is vacuum plated, electroplated, or chemical plated on one side or two sides of the sheet metal layer.

8. A method of preparing the arc-ablation resistant tungsten alloy switch contact according to claim 1, the method comprising:

(1) treating the sheet metal layer, which is a stainless steel sheet, a copper sheet, a copper alloy sheet, a nickel sheet, or a nickel alloy sheet, by using a cleaning agent and an organic solvent to deoil and clean the sheet metal layer; or by mechanically roughing a surface of the sheet metal layer through sand blasting and polishing; or by processing the sheet metal layer through chemical etching to form concave pits or convex points having a diameter less than 1 mm; then using the cleaning agent and the organic solvent to deoil and clean the sheet metal layer;

(2) adhering the hydrophobic rubber material onto the sheet metal layer through heat vulcanization shaping; or adhering the hydrophobic rubber material with self-adhesiveness on the sheet metal layer through heat vulcanization adhesion, thus forming a layered composite sheet;

(3) separating or punching the layered composite sheet into a cylinder having a diameter of 2-10 mm; or separating or punching the layered composite sheet into an object having a cross section in a shape of ellipse, polygon, crisscross, star or crescent or any combinations thereof; using a basic cleaning liquid to wash the cylinder or the object for about 5 minutes, washing the cylinder or the object with water, then using 5% hydrochloric acid to clean the cylinder or the object for about 3 minutes, using deionized water to clean the cylinder or the object, and then draining off the cylinder or the object;

(4) dipping the cylinder or the object in a chemical plating bath containing a soluble tungsten compound and stirring to form the tungsten alloy plated layer on a metal surface of the cylinder or the object using a method of chemical plating; or putting the cylinder or the object into a roller for the chemical plating bath to make the roller rotate and form the tungsten alloy plated layer on the metal surface of the cylinder or the object using the method of chemical plating, thus obtaining a plated object or a plated cylinder;

wherein the chemical plating bath contains 25-125 g/L of the soluble tungsten compound, 0-60 g/L of a soluble compound of a transition metal of ferrum, nickel, cobalt, copper or manganese or any combination thereof, 0-30 g/L soluble compound of tin, stibium, lead or bismuth or any combination thereof, 20-100 g/L reducing agent, 30-150 g/L complexing agent, 20-100 g/L pH adjuster, 0.1-1 g/L stabilizer, 0.1-1 g/L surfactant, and 0-50 g/L brightener or roughness adjuster;

wherein if sodium hypophosphite is adopted as the reducing agent, the chemical plating bath has a temperature of 60-85° C., the cylinder or the object remains in the chemical plating bath for 30-300 min, and a pH value of the chemical plating bath is 8.0-10.0; and (5) taking out the plated object or the plated cylinder from the chemical plating bath, using distilled water or deionized water to clean the plated object or the plated cylinder multiple times, then draining off the plated object or the plated cylinder, and putting the plated object or the plated cylinder in a 75° C. constant temperature drying oven to dry, thus obtaining the switch contact with the metal surface layer coated with the tungsten alloy.

9. The method of claim 8, wherein the reducing agent in the plating bath is sodium hypophosphite.

10. The method of claim 8, wherein the stabilizer is a mixture of one or more of potassium iodide, potassium iodate, benzotriazole, 4,5-dithiaoctane-1,8-disulfonate, 3-mercapto-1-propanesulfonate, sodium thiosulfate and thiourea.

11. The method of claim 10, wherein the stabilizer is sodium thiosulfate, thiourea or a mixture of the two.

12. The method of claim 8, wherein the reducing agent includes sodium hypophosphite, sodium borohydride, alkylamine borane, hydrazine or titanium trichloride.

13. The method of claim 12, wherein the reducing agent is sodium hypophosphite.

14. The method of claim 8, wherein the surfactant is one or more of dodecyl benzene sulfonate, lauryl sulfate and sodium n-octyl sulfate.

15. The method of claim 14, wherein the surfactant is sodium dodecyl sulfate or sodium dodecylbenzene sulfonate.

16. The method of claim 8, wherein the brightener or roughness adjuster is one or more of formaldehyde, acetaldehyde, β-naphthol, 2-methyl aniline-aldehyde condensates, benzalacetone, cuminaldehyde, benzophenone, chlorobenzaldehyde, peregal, schiff base, butynediol, propiolic alcohol, 1-diethylaminoprop-2-yne, propynol ethoxylate, saccharin, sodium benzosulfimide, sodium vinylsulfonate, sodium proparagylsulfonate, pyridine-2-hydroxypropanesulfonate inner salt, alkylphenol polyoxyethylene.

* * * * *